United States Patent [19]

Anderson

[11] Patent Number: 4,604,148

[45] Date of Patent: Aug. 5, 1986

[54] METHOD OF INCREASING THE PHASE STABILITY AND THE COMPRESSIVE YIELD STRENGTH OF URANIUM-1 TO 3 WT. % ZIRCONIUM ALLOY

[75] Inventor: Robert C. Anderson, Crossville, Tenn.

[73] Assignee: The United States of America as represented by the United States Department of Energy, Washington, D.C.

[21] Appl. No.: 554,487

[22] Filed: Nov. 22, 1983

[51] Int. Cl.[4] ..... C21D 1/00

[52] U.S. Cl. ..... 148/132; 148/12.7

[58] Field of Search ..... 148/132, 12.7

[56] References Cited

U.S. PATENT DOCUMENTS

| | | | |
|---|---|---|---|
| 2,830,896 | 4/1958 | Seybolt | 148/132 |
| 2,947,621 | 8/1960 | Foote | 148/132 |
| 3,715,243 | 2/1973 | Clayton | 148/12.7 |

*Primary Examiner*—Theodore Morris

*Attorney, Agent, or Firm*—Earl L. Larcher; Stephen D. Hamel; Judson R. Hightower

[57] ABSTRACT

A uranium-1 to 3 wt. % zirconium alloy characterized by high strength, high ductility and stable microstructure is fabricated by an improved thermal mechanical process. A homogenous ingot of the alloy which has been reduced in thickness of at least 50% in the two-step forging operation, rolled into a plate with a 75% reduction and then heated in vacuum at a temperature of about 750° to 850° C. and then quenched in water is subjected to further thermal-mechanical operation steps to increase the compressive yield strength approximately 30%, stabilize the microstructure, and decrease the variations in mechanical properties throughout the plate is provided. These thermal-mechanical steps are achieved by cold rolling the quenched plate to reduce the thickness thereof about 8 to 12%, aging the cold rolled plate at a first temperature of about 325° to 375° C. for five to six hours and then aging the plate at a higher temperature ranging from 480° to 500° C. for five to six hours prior to cooling the billet to ambient conditions and sizing the billet or plate into articles provides the desired increase in mechanical properties and phase stability throughout the plate.

3 Claims, No Drawings

METHOD OF INCREASING THE PHASE STABILITY AND THE COMPRESSIVE YIELD STRENGTH OF URANIUM-1 TO 3 WT. % ZIRCONIUM ALLOY

This invention was made as a result of work under contract W-7405-ENG-26 between Union Carbide Corporation Nuclear Division and the U.S. Department of Energy.

BACKGROUND OF THE INVENTION

The present invention relates generally to corrosion resistant uranium-1 to 3 wt. % zirconium alloys and more particularly to a method for increasing the microstructure phase stability and compressive yield strength of such alloys by a thermal mechanical treating process.

Uranium metal is well known for its use in the nuclear industry and has found considerable use in other areas such as armor penetrators and ballast because of its high density. The corrosion of uranium by various gases and liquids has been a considerable drawback but this problem has been considerably eased by alloying the uranium with various metals. These alloying metals are also used to increase the strength, ductility and stability of the uranium metal in its intended application. For example, alloying uranium with zirconium has shown to provide an alloy possessing corrosion resistance and good strength and ductility properties. The addition of about 1 to 3 wt. % zirconium to uranium is typical of the zirconium additions to provide the uranium-zirconium alloy. While the mechanical properties of the uranium-zirconium alloy are satisfactory for many applications, in some instances the microstructure phase does not provide the strength and stability levels expected of the alloy due to the microstructure phase being considerably distorted during the various forging and rolling operations.

SUMMARY OF THE INVENTION

It is the primary aim or objective of the present invention to provide a thermal mechanical method for increasing the phase stability and the compressive yield strength of corrosion resistant uranium-1 to 3 wt. % zirconium alloy make it more practical in applications such as armor penetrators. Generally, uranium-zirconium alloys are prepared by arc melting uranium with a selected percentage of zirconium in the 1 to 3 wt. % range, homogenizing the constituents of the resulting ingot by heating, reducing the thickness of the ingot by upset forging, rolling the forged ingot into plate or other configuration, heating the plate in a vacuum to a temperature of about the gamma transformation temperature in the range of about 750° to 850° C. for a sufficient duration to anneal the alloy, and then quenching the plate to ambient temperature. This procedure provides the uranium-zirconium alloy with fairly high yield strengths and corrosion resistance. An increase of about 30% in the compressive yield strength and an increase in phase stability is provided by the improvement of the present invention which comprises the steps of cold rolling the plate after quenching to further reduce the thickness of the plate, aging the cold rolled plate at a first temperature, thereafter aging the cold rolled plate second temperature higher than the first temperature, and then cooling the plate to ambient temperature. After the final cooling the plate is sized into the articles desired of the uranium-zirconium alloy.

The thermal mechanical steps of the present invention provide additional equilibrium alpha and delta phase in the uranium to considerably improve the compressive yield strength and also stabilize the microstructure by overcoming the thickness and elongation problems associated with the microstructure during the treatment of the alloy prior to the improvement provided by the present invention.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

As briefly described above, the present invention is directed to a method for improving the physical properties of uranium-1 to 3 wt. % zirconium alloys. By practicing the present invention, the compressive yield strength of the uranium-zirconium alloy is increased about 30% over that of similar alloy articles provided by practicing the conventional fabricating or plate forming techniques. Also, the microstructure of the alloy is considerably stabilized over that provided by conventional practices used in forming articles of the alloy.

In practicing the present invention, the uranium-1 to 3 wt. % zirconium alloy is first prepared by casting a ingot of uranium with the desired concentration of zirconium to form the alloy. Typically, the uranium metal is arc melted together with a selected percentage of zirconium to provide a ingot of the alloy. The ingot is then heated to a temperature in the range of about 950° to 1,050° C. for about three to five hours in a vacuum furnace to homogenize the metals in the ingot. The homogenous ingot of the uranium-zirconium alloy is then reduced in thickness by at least 50% in a two-stage upset forging operation in which the ingot is heated to about 800° C. prior to each forging operation. The upset forged ingot is then rolled into a plate with a reduction of about 75% at a rolling temperature in the range of about 550° to 650° C. This plate is then annealed by heating the plate in a vacuum furnace to a temperature in the range of about 750° to 780° for a period of about two to three hours. The plate is then quenched in turbulent water to ambient temperature of about 20° to 24° C. The cast and homogenized ingot of the alloy exhibits equilibrium alpha and delta phases of uranium. These phases of uranium are present after the upset forging and rolling operations but the grains of uranium are reduced in thickness and are elongated. After the heating and water quench step, alpha prime and equilibrium alpha plus delta microstructure phases are present in uranium alloys. Samples of the plate formed of uranium 2.4 wt. % zirconium were overaged at a temperature of about 635° C. for two hours in a vacuum furnace, cooled to room temperature at a rate of about 5° C. per hour and then cold rolled with a 9% reduction to improve the mechanical properties of the alloy. These mechanical properties provided an average tensile yield strength of 912 MPa in a direction parallel to the rolling and 691 MPa compressive yield strength at a 0.2% offset for the same sample.

The heating and rolling steps subsequent to the water quenching of the plate did not provide the desired mechanical properties and microstructure desired of the alloy. Accordingly, the thermal and mechanical process of the present invention was provided to give the alloy a substantial increase in compressive yield strength while providing minimum variations in mechanical properties over the length of the plate. In practicing the present invention, the water quenched plate was cold rolled at a reduction in thickness of about 8 to 12%. The rolled plate was then aged at a first temperature in the range of about 325° to 375° C. for a duration in the range of about five to six hours. The plate was then again aged at a higher temperature in the range of about 480° to 500° C. for a similar period of time. The plate was then cooled to ambient conditions for sizing into the desired structures. During the cold rolling operation, the grains in the structure were elongated and flattened and the aging operations at both temperatures converted the alpha prime into additional equilibrium alpha and delta phase uranium. This additional equilibrium alpha and delta phase in the uranium strengthened and stabilized the uranium alloy. An analysis of a uranium-2.4 wt. % zirconium indicated a compressive yield strength at 0.2% offset in the direction parallel to the rolling at 999 MPa which represents about a 30% increase over that provided by the previously used mechanical treatments.

In a typical fabrication of a plate of uranium-zirconium alloy in accordance with the present invention, uranium and zirconium metal strips in stoichiometric quantities for forming a uranium-2.4 wt. % alloy were tack welded together to form an electrode. This electrode was then double arc melted into an ingot having a diameter of 20.3 cm and a length of 55.9 cm. Five cm were cropped from the top of the ingot and 10.2 cm were cropped from the bottom of the ingot. Samples of the ingot were collected from the top and bottom for chemical analysis which indicated that the zirconium content at the top was 2.37 wt. % while the bottom contained 2.43 wt. %. The cropped ingot was then homogenized at 1,000° C. for four hours in a vacuum furnace, cooled to room temperature in the furnace and machined to a billet having a diameter of 19 cm and a length of 39.4 cms. This billet was heated to 800° C. for four hours in an argon atmosphere then upset forged in two steps to a thickness of 12.7 cm while reheating to 800° C. before each upset forging step. The billet was then round rolled at a temperature of 575° C. in an argon atmosphere at approximately 8% reduction per pass into a plate with a final thickness of 4 cm. A section 13.3 cm in width and 20.3 cm in length was cut from this plate and heated to a temperature of 750° to 780° C. for two hours in a vacuum of 6.7 mPa, solution quenched in water to room temperature, cold rolled at a rate of 0.25 mm per pass to a final thickness of 3.62 cm for an overall reduction of 9% in thickness. The cold rolled plate was then aged at a first temperature of 325° to 375° C. for a period of five to six hours and then again aged at a second and higher temperature of 480° to 500° C. for a period of five to six hours before cooling to room temperature.

The steps of cold rolling the plate for reduction in thickness of 8–12% after the plate was water quenched from the 750° to 850° C. to room temperature and then aging the plate or the cold rolled article at a first temperature of 325° to 375° C. for a period of about five to six hours and then again aging the alloy a second time at a temperature ranging from 480° to 500° C. for a period of about five to six hours provides for the conversion of alpha prime into additional equilibrium in an alpha-delta phase uranium to increase the compressive yield strength of the alloy at a 2% offset approximately 30%. These steps also assure that variations in the mechanical properties throughout the rolled plate will be substantially less than previously provided.

I claim:

1. A method for increasing the phase stability and the compressive yield strength of a corrosion resistant uranium-1 to 3 wt. % zirconium alloy comprising the steps of reducing the thickness of a homogeneous ingot of the alloy by upset forging, rolling the forged ingot into a plate, heating the plate in vacuum to a temperature about the gamma transformation temperature and water quenching the plate to ambient temperature with said alloy exhibiting alpha prime and equilibrium alpha plus delta phases, the improvement comprising the steps of cold rolling the plate after said quenching to further reduce the thickness of the plate, aging the cold rolled plate at a first temperature, thereafter aging the cold rolled plate at a second temperature higher than said first temperature for converting alpha prime phase into additional equilibrium alpha and delta phases, and cooling said plate to ambient temperatures.

2. The method as claimed in claim 1 wherein the cold rolling of the plate provides a reduction in thickness in the range of about 8 to 12%.

3. The method as claimed in claim 2 wherein aging the cold rolled plate at said first temperature is provided at a temperature in the range of 325° to 375° C. for a duration of about five to six hours, and wherein the aging at said second temperature is provided at a temperature in the range of about 480° to 500° C. for a period of about five to six hours.

* * * * *